United States Patent [19]

Puhak et al.

[11] Patent Number: 4,588,250

[45] Date of Patent: May 13, 1986

[54] CONNECTIVE-PROTECTIVE ADAPTER FOR A CRT BASE

[75] Inventors: Peter G. Puhak; Charles H. Rehkopf, both of Seneca Falls, N.Y.

[73] Assignee: North American Philips Consumer Electronics Corp., New York, N.Y.

[21] Appl. No.: 538,621

[22] Filed: Oct. 3, 1983

[51] Int. Cl.[4] ..... H01R 33/74

[52] U.S. Cl. ..... 339/144 T; 339/156 T

[58] Field of Search ..... 339/144 R, 144 T, 145 D, 339/145 R, 145 T, 111, 156 T; 313/318, 477 HC

[56] References Cited

U.S. PATENT DOCUMENTS

| | | | |
|---|---|---|---|
| 3,979,157 | 9/1976 | DiMattio | 339/186 T |
| 4,148,541 | 4/1979 | Marks | 339/144 T |
| 4,155,618 | 5/1979 | Regnault et al. | 339/145 R |
| 4,158,152 | 6/1979 | Puhak et al. | 339/144 T |
| 4,334,731 | 6/1982 | Amin et al. | 339/144 T |

*Primary Examiner*—Gil Weidenfeld
*Assistant Examiner*—Thomas M. Kline
*Attorney, Agent, or Firm*—John C. Fox

[57] ABSTRACT

A connective-protective adapter for use with a silo-type cathode ray tube base provides both connector pin protection and electrical connective means for all active pins of the tube. The adapter permits affixation of the permanent base to the tube early in tube processing, thereby eliminating the need for temporary processing bases, and provides pin protection on the finished tube.

6 Claims, 4 Drawing Figures

CONNECTIVE-PROTECTIVE ADAPTER FOR A CRT BASE

BACKGROUND OF THE INVENTION

1. Field Of The Invention

This invention relates to cathode ray tube bases, and more particularly to a connective-protective adapter for use with a CRT base to provide both connector pin protection and versatile electrical connective means for the tube.

2. Background Art

In cathode ray tubes of the type commonly utilized in television and allied display applications, most external electrical connections are made through a plurality of connective pins or leads traversing and extending outwardly from the neck closure of the tube. These pins are usually spacedly oriented in an annular array surrounding the sealed exhaust tubulation of the tube.

During tube processing and subsequent tube utilization, large potential differentials, in the order of many kilovolts, are applied between certain of the connector pins. Thus, it is common practice to incorporate arc protective means into the tube bases temporarily utilized in tube processing and also into those bases applied to the finished tubes.

It is also essential that connector pin alignment be maintained to facilitate efficient base application and socket insertion. Any bend in a pin or pins, however slight, significantly increases insertion force, and may even prevent basing or socketing. To promote straightness, individual pin enclosure means, such as pin-accommodating bores formed in temporary pin protective means have been used, as for example, those taught in U.S. Pat. Nos. 4,158,152; 4,273,400; and 4,152,040. Other protective means for maintaining pin straightness have also been incorporated into base structures. For instance, a plurality of open longitudinal channels or grooves formed in the base structure support the individual leads while enabling side electrical contact with them. Such a structure, as disclosed in U.S. Pat. Nos. 3,979,157 and 4,040,708, also provides alleviation of inter-pin arcing.

To insure straightness and electrical isolation of a specific high voltage pin such as the focus lead from the other pins, a silo-type base has been developed. As disclosed in U.S. Pat. No. 4,345,812, the silo is a tubular structure formed as an integral part of the base.

Such base structures are designed to mate with conventional sockets in equipment such as TV chassis, and are thus affixed to the finished tubes. Prior to affixing of such final base, however one or more processing bases are applied to the tube at certain manufacturing stations, for instance to provide the high voltage focus lead with an external connection for electrical processing. CRT processing is a multi-step procedure initially involving heating of the gun structure, conditioning of the thermionic cathodes, and exhausting of internal gasses. Subsequent to the sealing of the exhaust tubulation, the tube is conditioned by application of discrete potentials to specific tube electrode elements to electrically stabilize the tube and minimize the possibilities of inter-electrode arcing. To achieve this desired electrical conditioning, temporary bases and other connective means are conventionally utilized. The application and removal of the temporary processing bases and the ultimate affixation of the final permanent base represent appreciable time and cost considerations in tube manufacturing.

SUMMARY OF THE INVENTION

It is an object of the present invention to provide a connective-protective adapter for use with a silo-type cathode ray tube base. Use of this adapter permits the final silo-type base to be affixed to the tube early in the tube processing procedure and remain permanently attached thereto. The adapter provides for open electrical contact with the silo-enclosed high voltage lead required during processing.

The tube base is a cap-like structure formed of insulative material, comprising a central hollow cap-like portion with cylindrical sidewalls, oriented to enclose the sealed exhaust tubulation of the tube; a circular flange-like seating member extending from the base of the cap and having an array of pin receiving apertures therein surrounding the cap; and at least one tubular isolation structure or silo formed as an integral upstanding part of the base structure and evidencing a height exceeding the length of the high voltage pin intended to be positioned therein.

The connective-protective adapter is a crown-like structure formed of insulative material. The adapter structure comprises a substantially cylindrical member having a longitudinal axis therethrough, with proximal and distal ends and a central cavity having a length exceeding the height of the silo of the related base. The cavity of the adapter is formed to slidingly encompass the central cap of the base in a frictionally engaging manner, whereupon the proximal end of the adapter is brought into abutting relationship with the seating flange of the base.

The exterior surface of the adapter is formed in part of a plurality of upstanding ridges to provide a plurality of open longitudinal channels wherein the tube connector pins are individually accommodated in a protective environment, while having an outside portion exposed for electrical contact. The wall of the cylindrical member defines a longitudinal slot formed to enable the adapter to straddle the silo structure of the base. Above this slot, a longitudinally projecting component is integrally attached to the distal region of the cylindrical wall, and extends therefrom in a spaced manner along the slot toward the proximal end thereof.

This projecting component has a tubular element formed to compatibly fit into the silo structure of the base. The tubular element defines a cavity having forward and rearward wall portions, and has an open distal end and a closure proximal end defining an aperture therethrough to receive the isolated connector pin oriented in the silo structure of the base. This pin-accommodating aperture is oriented in a manner to position the isolated pin substantially contiguous to the rearward wall of the cavity.

A resilient electrical connective element is located within the cavity of the tubular element to provide pressured contact with the isolated tube connector pin positioned therein. This connective element is formed to be affixed to substantially the distal end of the component in a manner to provide external electrical connective means for the isolated connector pin of the base.

In accordance with one embodiment of the invention, the electrical connective element is formed to be affixed to the distal end of the projecting component to effect at least a partial closure of the aperture. The affixation portion has an external conductive surface to provide an end-oriented electrical contact area.

In accordance with another embodiment, the projecting component has an outwardly protruding ledge formed at the distal end thereof to seat on the associated distal end of the base silo. In this embodiment, the electrical connective element has a portion formed to set on and be affixed to the distal ledge of the projecting component, to provide an end-oriented electrical contact area. Additionally, the seating portion of the connective element may extend around the outer wall of the protruding ledge, to effect wrap-around engagement therewith and to provide a side-oriented electrical contact area.

A recess in the distal surface of the protruding ledge may be provided to accommodate the seating portion of the connective element therein, the depth of the recess preferably being less than the material thickness of the element.

Use of the protective-connective adapter permits application of the permanent tube base early in tube processing, thereby eliminating the need for special processing bases. Furthermore, its utilization greatly reduces the incidences of bent pins resulting from repeated test socketings. Thus, the adapter effect important time and cost saving advantages in tube processing. In addition, the adapter may be retained on the tube as a pin protector during subsequent transportation of the finished tube. The discretely exposed electrical contact areas provided by the adapter permit testing or use of the tube with the adapter in place utilizing compatible socketry or other connective means. Alternatively, the adapter may be removed and either discarded or returned to the tube maker by the end user.

DESCRIPTION OF THE PREFERRED EMBODIMENTS

Figure 1:
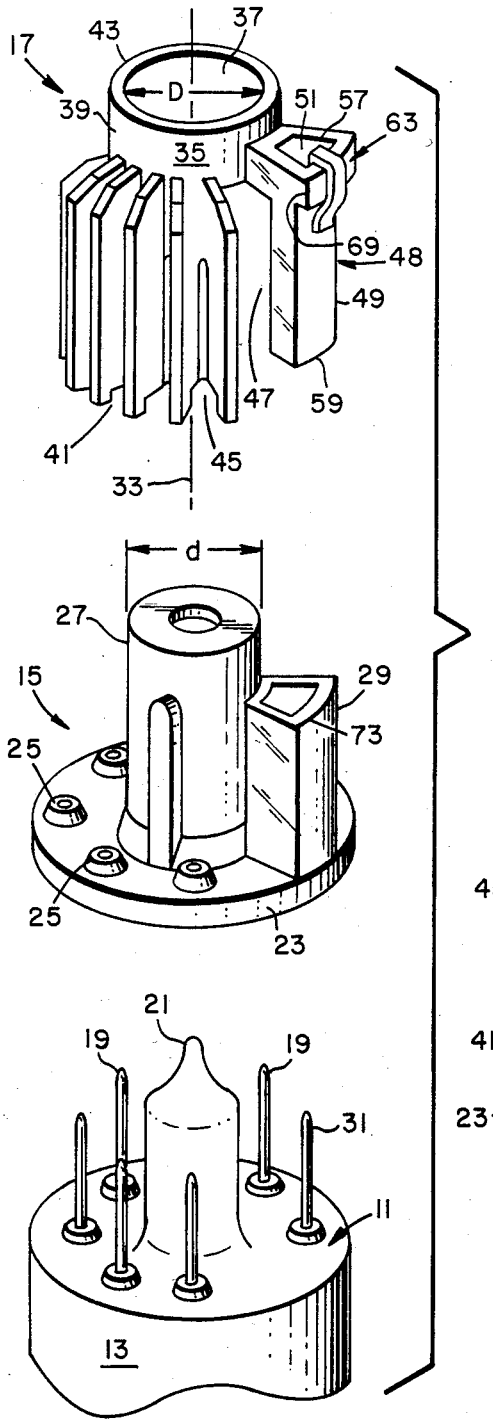
FIG. 1 is an exploded perspective view showing the unassembled relationship of the adapter of the invention to a silo-type base and a cathode ray tube.
Figure 2:
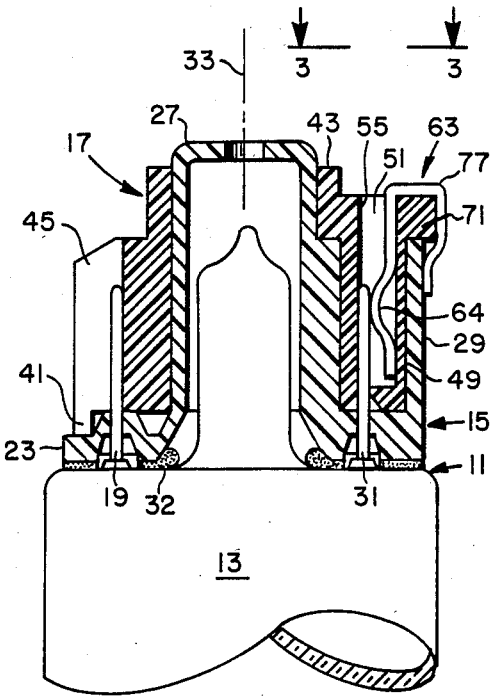
FIG. 2 is a sectioned elevation view illustrating the assembled association of the adapter with the base and the tube.

With reference to the drawings, there is shown in FIG. 1 an exploded perspective view of the relationship of the closure portion 11 of a cathode ray tube (CRT) 13, the base 15 to be mated therewith, and the connective-protective adapter 17 to be fitted onto the base. FIG. 2 presents the assemblage of these elements, illustrating in cross-section the compatible relationship therebetween.

In greater detail, the closure portion 11 of the CRT 13 evidences an annular array of exteriorly protruding connector pins 19 surrounding the sealed exhaust tubulation 21. The tube base 15 seated upon and affixed to the tube closure portion, has a circular flange-like seating member 23 having a matching array of pin receiving apertures 25 therein surrounding a central hollow cap-like portion 27 oriented to enclose the sealed tubulation 21. In addition, the base evidences at least one integral upstanding tubular structure 29 located to encompass and thereby insure straightness and electrical isolation of a specific high voltage pin 31. Since the tubular formation resembles a silo structure, a base of this construction is conventionally referenced in the art as a silo-type base. As shown, the height of the silo 29 exceeds the length of the high voltage isolated connective pin 31 positioned therein. It is conventional practice to adhere the final base 15 to the tube closure portion 11 with a suitable state-of-the-art dielectric adhesive medium 32.

The invention resides in the versatile connective-protective adapter 17, a crown-like structure having a longitudinal axis 33 therethrough. The structure is basically formed of a substantially rigid insulative material, such as a suitable plastic composition, and shaped as a hollow open-ended substantially cylindrical member 35 having interior and exterior surfaces 37 and 39 with proximal and distal ends 41 and 43. As shown, the length of the cylindrical wall member 35 exceeds the height of the silo or pin isolation structure 29 of the related tube base 15.

The internal diameter "D" of the hollow wall member 35 is slightly larger than the external diameter "d" of the cap-like portion 27 of the base, so that the interior surface 37 of the adapter slidingly encompasses the central cap-like portion in a frictionally engaging manner, and the proximal end 41 of the adapter is located to abut the flange member 23 of the base.

The exterior surface 39 of the adapter supports a plurality of fins or ridges defining open longitudinal channels 45 wherein the tube connector pins 19 are individually accommodated in a protective environment and have a side portion exposed for sidewipe electrical contact in compatible mating socket means, not shown.

At a discrete location the wall 35 of the adapter 17 has a longitudinal cut-out portion or slot 47 which is located to allow the adapter to spatially straddle the silo structure 29 of the base 15. In this region, a longitudinal projecting component 49 is integrally attached to the distal region 43 of the wall member 35 of the adapter. The component 49 extends therefrom in a spaced manner through the region 47 toward the proximal end of the adapter in a longitudinal plane parallel with the axis 33.

The projecting component 48 includes a substantially hollow tubular element 49 positioned to compatibly fit into the hollow tubular silo structure 29 of the base. The element evidences a wall-defined tubular cavity 51 demarcated by forward and rearward wall portions 53 and 55. Additionally, the element is formed to have an open distal end 57, and a partially closured proximal end 59 featuring an aperture 61 therethrough to receive the isolated connector pin 31 oriented in the silo structure 29 of the base. As shown in the drawings, the pin accommodating aperture 61 is oriented in a manner to protectively position the adapter so that the rearward wall 55 defining the cavity 51 is substantially contiguous to the isolated pin 31.

To provide external electrical connective means for the isolated connector pin 31, a resilient strip-like electrical connective element 63 is positioned with a contacting portion 64 within the cavity 51 of the tubular element 49 and shaped to provide resilient pressured contact with the pin. Since the isolated pin 31 is given beneficial support by the rearward wall 55, adequate contact pressure can be applied there against by the resilient connective element without danger of bending or otherwise deforming the pin. This connective element extends beyond the cavity to provide the desired external connective area, and is affixed to substantially the distal end of the component.

Figure 4:
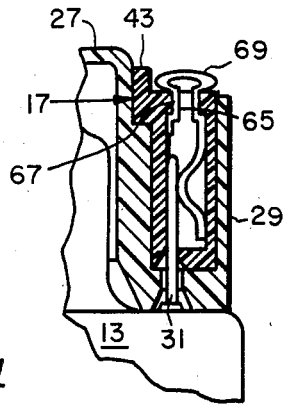
FIG. 4 is a sectioned elevation view depicting another embodiment of the adapter of the invention.

In one embodiment of the invention, as shown in FIG. 4, the external portion of the connective element 63 is a substantially T-shaped expansive construction 65, being configurated to seat on and mate with terminal wall formation 67 in the projecting component 48. The top surface 69 of the T-shaped portion effects at least a partial closure of cavity 51, while providing a desired external end-oriented electrical contact area for pin 31.

Figure 3:
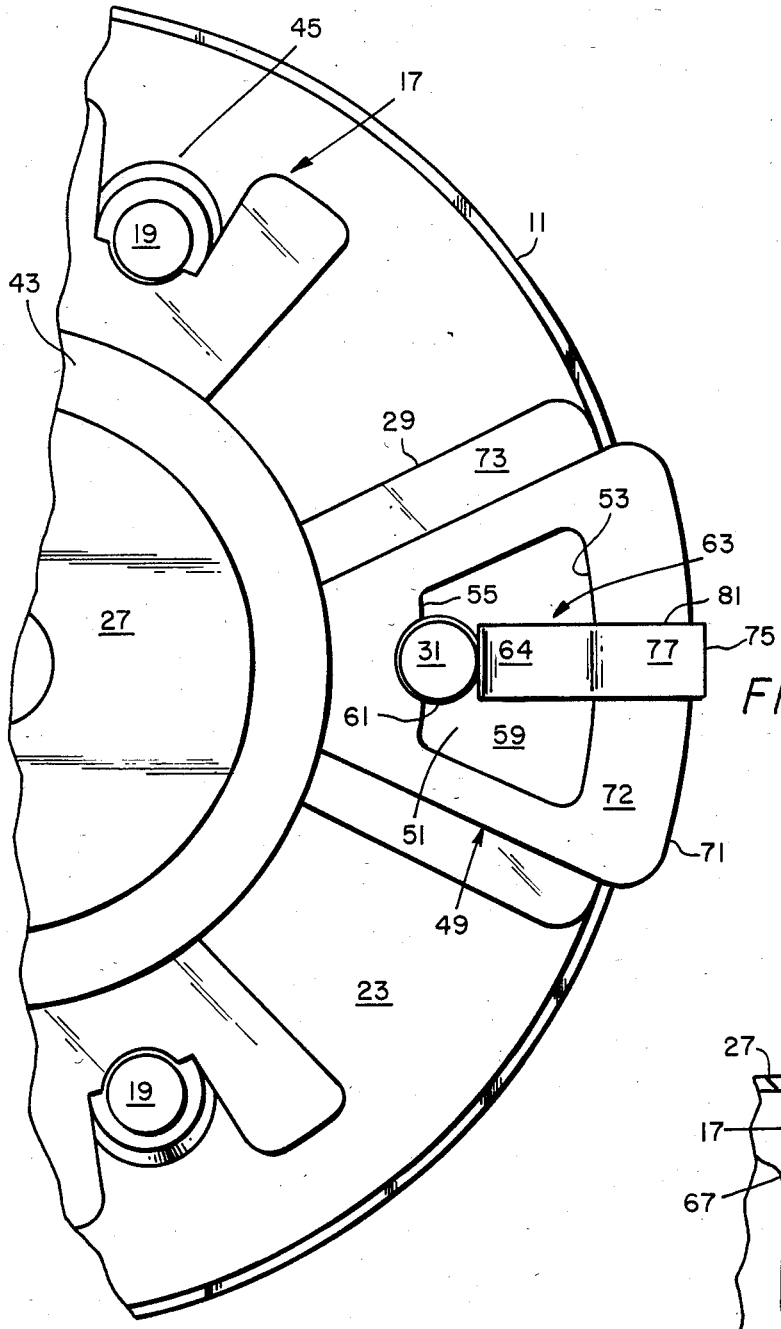
FIG. 3 is an enlarged partial plan view, taken along the line 3—3 of FIG. 2, showing details of the adapter of the invention.

In accordance with another embodiment of the invention, as illustrated in FIGS. 1, 2, and 3, the forward wall portion 53 of the projecting component 48 of the adapter 17 has an outwardly protruding ledge 71 which is formed at the distal end 57 thereof. This ledge is fashioned to seat on the end 73 of the base silo structure 29 and to slightly outstand therefrom, as clearly delineated in FIGS. 2 and 3. In this embodiment, the external portion 75 of the connective element is formed to seat on the outstanding distal ledge 71 of the projecting component, to provide an end-oriented electrical contact area 77 for pin 31. Furthermore, in this embodiment, the external portion 75 of connective element 63, effects substantially wrap-around engagement with the protruding ledge 71 in a manner to provide an additional side-oriented electrical contact area.

To provide more positive placement of the connective element, a recess 81 may be formed in the surface 72 of the ledge 71 to accommodate seating of the connective element therein, as shown in FIG. 3. It is preferred that the depth of the recess be less than the material thickness of the element to provide prominence for the externally exposed contact areas for pin 31.

We claim:

1. A connective-protective adapter for use with a cathode ray tube including a closure portion having a sealed exhaust tubulation, and an annular array of exteriorly protruding connector pins surrounding the tubulation, the tube also including a base, said base formed to seat on the closure portion, and having a circular flange-like seating member surrounding a central hollow cap-like portion oriented to enclose the tubulation, the seating member having an annular array of connector pin accommodating apertures, at least one of said connector pin apertures being isolated by a tubular isolation structure formed as an integral upstanding part of said base and having a length exceeding that of the isolated connector pin;

the adapter being a crown-like structure with a longitudinal axis there through comprising; a substantially cylindrical wall member having interior and exterior surfaces with proximal and distal ends defining a cavity having a length exceeding the length of said base isolation structure, said cylindrical wall member being formed to slidingly encompass the cap-like portion of said base in a frictionally engaging manner, whereby the proximal end thereof abuts the seating member of said base; a plurality of longitudinal ridges spaced apart on the exterior surface of the cylindrical wall member to form a plurality of open longitudinal channels to individually accommodate said tube connector pins in an exposed protective environment; said cylindrical wall member defining a slot to spatially straddle the tubular isolation structure of said base; a longitudinally projecting component integrally attached to the region of the distal end of said wall member and extending in a spaced manner past said slot toward said proximal end, said projecting component including a tubular element formed to compatibly fit into the tubular isolation structure of the base, said tubular element defining a cavity having forward and rearward wall portions, an open distal end, and a proximal end defining an aperture there through to accommodate said isolated connector pin; a resilient electrical connective element positioned within the cavity of said tubular element to provide pressured contact with the isolated connector pin, said connective element being affixed to the distal end of said projecting component in an exposed manner to provide external electrical contact for the isolated connector pin, characterized in that said projecting component has an outwardly protruding ledge located at the distal end of said tubular element, the ledge formed to seat on and slightly outstand from the distal end of said tubular isolation structure of said base when said adapter engages said base.

2. The connective-protective adapter for use with a cathode ray tube base according to claim 1 wherein the pin accommodating aperture in the proximal end of the tubular element is oriented to position said isolated pin substantially contiguous to the rearward wall of the cavity.

3. The connective-protective adapter for use with a cathode ray tube base according to claim 1 wherein said electrical connective element is formed to be affixed to the distal end of said tubular element to effect at least a partial closure of said cavity, and to provide an end-oriented electrical contact area.

4. The connective-protective adapter for use with a cathode ray tube base according to claim 1 wherein said electrical connective element has a portion formed to seat on and be affixed to the ledge of said projecting component.

5. The connective-protective adapter for use with a cathode ray tube base according to claim 4 wherein said connective element has a portion seated against an upper surface of the protruding ledge of said projecting component to provide an end-oriented electrical contact area.

6. The connective-protective adapter for use with a cathode ray tube base according to claim 4 wherein said connective element has a portion shaped to substantially conform to said protruding ledge to effect wrap-around engagement therewith and to provide a side-oriented electrical contact area.

* * * * *